US006186651B1

(12) United States Patent
Sayers et al.

(10) Patent No.: US 6,186,651 B1
(45) Date of Patent: Feb. 13, 2001

(54) BIFUNCTIONAL HIGH INTENSITY DISCHARGE PROJECTOR HEADLAMP

(75) Inventors: Edwin Mitchell Sayers, Saline; Balvantrai Patel, Rochester Hills, both of MI (US); David Vozenilek, Ostrava Poruba (CZ); Jeyachandrabose Chinniah, Ann Arbor, MI (US); Jose M. Cruz, Livonia, MI (US); Jeffrey Allen Erion, Plymouth, MI (US); Jaroslav Purma, Karvina; Milan Cejnek, Novy Jicin, both of (CZ)

(73) Assignee: Visteon Global Technologies, Inc., Dearborn, MI (US)

( * ) Notice: Under 35 U.S.C. 154(b), the term of this patent shall be extended for 0 days.

(21) Appl. No.: 09/358,041

(22) Filed: Jul. 21, 1999

(51) Int. Cl.[7] ..... F21V 17/02

(52) U.S. Cl. ..... 362/512; 362/539; 362/508; 362/270; 362/277; 362/538; 362/513

(58) Field of Search ..... 362/539, 538, 362/512, 513, 514, 508, 270, 277

(56) References Cited

U.S. PATENT DOCUMENTS

| | | | | |
|---|---|---|---|---|
| 5,180,218 | | 1/1993 | Ohshio . | |
| 5,339,226 | * | 8/1994 | Ishkawa | 362/61 |
| 5,414,301 | | 5/1995 | Davenport et al. . | |
| 5,423,127 | | 6/1995 | Deslandres . | |
| 5,436,807 | | 7/1995 | Kobayashi . | |
| 5,539,625 | | 7/1996 | Turley, Jr. et al. . | |
| 5,709,451 | | 1/1998 | Floras et al. . | |
| 5,899,559 | * | 5/1999 | Lachmayer et al. | 362/513 |
| 5,902,039 | | 5/1999 | Futami . | |
| 5,906,431 | * | 5/1999 | Chinale et al. | 362/515 |
| 5,911,502 | | 6/1999 | Zillgitt et al. . | |
| 5,915,829 | * | 6/1999 | Kaize et al. | 362/465 |

* cited by examiner

*Primary Examiner*—Stephen Husar
*Assistant Examiner*—Ali Alavi
(74) *Attorney, Agent, or Firm*—Larry I. Shelton

(57) ABSTRACT

A projector headlamp utilizing only a single HID bulb for projecting light in a forward direction generally along a horizontal axis selectably between low beam and high beam conditions while shifting the hot spot as required between these conditions.

15 Claims, 6 Drawing Sheets

BIFUNCTIONAL HIGH INTENSITY DISCHARGE PROJECTOR HEADLAMP

BACKGROUND OF THE INVENTION

1. Field of the Invention

The present invention relates generally to automotive headlamps, and more particularly to HID (high intensity discharge) automotive headlamps.

2. Disclosure Information

HID headlamps are commonly used nowadays in automotive applications, in large part because of the quality of light produced and because of the longevity, energy efficiency, and reliability of the lamp bulbs. Conventional automotive applications of HID projector-type headlamps are disclosed in U.S. Pat. Nos. 5,180,218 to Ohshio 5,709,451 to Flora et al., both of which are incorporated herein by reference. FIG. 8 (taken from FIG. 1 of the aforementioned Flora et al. patent) illustrates a representative prior art approach for constructing an HID headlamp for low beam conditions, which includes a light shield 20 with its top edge 22 positioned immediately beneath the second focal point F2 of the elliptical reflector 10.

In conventional HID automotive headlamp applications, the common practice is to provide two of such headlamps on each of the left-hand and right-hand front areas of the vehicle; one of these two headlamps per side would be a low beam headlamp similar to FIG. 8, while the other headlamp would be an essentially similar high beam headlamp that would not include a light shield 20. Besides the fact that the low beam headlamp has a light shield while the high beam does not, another difference between low and high beam headlamps is the respective forward-projected points in space ("hot spots") that each must be aimed at, as well as glare and intensity requirements. These requirements are specified by the Federal Motor Vehicle Safety Standard (FMVSS) and other automotive vehicle standards of the U.S. and other countries.

Although there are significant benefits in utilizing HID-type lighting systems in automotive applications, one drawback is the need for two headlamps per vehicle side. It would be desirable to provide an HID-based lighting system for automotive headlamp applications which requires the use of only a single headlamp per vehicle side.

SUMMARY OF THE INVENTION

The present invention overcomes the disadvantages of the prior art approaches by providing a projector headlamp for projecting light in a forward direction generally along a horizontal axis selectably between high beam and low beam conditions which requires only one headlamp per vehicle side. One embodiment of the projector headlamp comprises: (a) a generally elliptical reflector having a reflector axis, first and second focal points located along the reflector axis, and a forward-facing reflector opening; (b) a light source from which light waves may emanate, the light source being located substantially at the first focal point; (c) a light shield disposed generally beneath the second focal point and having a top edge; (d) a condenser lens having a condenser axis, the condenser lens being disposed forward of the reflector opening and spaced apart from the second focal point effective to substantially collimate the light waves generally in the forward direction; and (e) means for selectably moving at least one of the light shield, the reflector, the condenser lens, and the light source between the low beam and high beam conditions. In the low beam condition, the reflector and condenser axes are substantially collinear and substantially parallel to the horizontal axis, and the light shield is oriented in a first position wherein the top edge is positioned immediately beneath the second focal point. In the high beam condition, the reflector and condenser axes are substantially collinear and raised by an angle A with respect to the horizontal axis, and the light shield is oriented in a second position wherein the top edge is lowered away from the second focal point. Other embodiments of the present invention are also provided.

It is an object and advantage that the present invention requires only one projector headlamp for accommodating both high and low beam lighting conditions, while providing for the difference in hot spot aiming between these two conditions.

Another advantage is that the HID projector headlamp of the present invention requires much less vehicle space than is required for conventional HID projector headlamps.

These and other advantages, features and objects of the invention will become apparent from the drawings, detailed description and claims which follow.

Figure 1A:
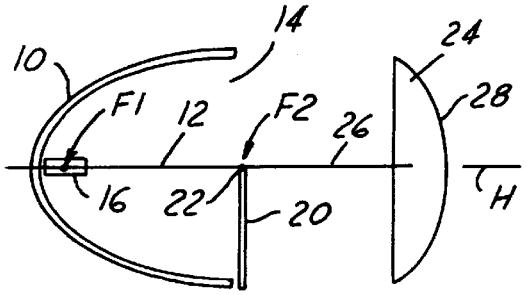
FIGS. 1A–B are side schematic views of a projector headlamp according to a first embodiment of the present invention, showing low beam and high beam conditions, respectively.

(Note: As variously used herein, "FIG. 1" refers to FIGS. 1A–B, "FIG. 2" refers to FIGS. 2A–B, and so forth.)

DETAILED DESCRIPTION OF THE PREFERRED EMBODIMENTS

Referring now to the drawings, FIGS. 1–7 show various embodiments of a projector headlamp according to the present invention. In each embodiment, the projector headlamp projects light in a forward direction (e.g., in a direction in front of a vehicle into which the headlamp is installed) generally along a horizontal axis H (e.g., running along the length of the vehicle), with the headlamp being operably selectable between low beam and high beam lighting conditions. (Note that drawings suffixed with an "A" or "B" represent low beam or high beam conditions, respectively.) In each embodiment, one or more elements of the projector headlamp assembly is moved with respect to the other elements when shifting between low beam and high beam modes, so as to provide the correct hot spot needed for each condition.

Figure 1B:
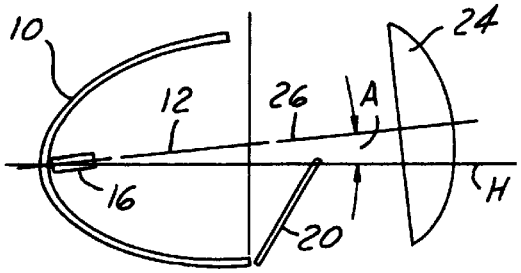

To assist the reader in understanding the present invention, all reference numbers used herein are summarized in the table below, along with the elements they represent:

10=Reflector
12=Reflector axis
14=Reflector opening
16=Light source
18=Light waves from light source
20=Light shield
22=Top edge of light shield
24=Condenser lens
26=Condenser lens axis
28=Forward face of condenser lens
29=Low Beam Hot Spot
30=Condenser lens ring
30A=High Beam Hot Spot
32=Pin/axis of rotation for condenser lens/ring
34=Condenser lens ring frame (fixed)
36=Linkage(s) for condenser lens ring
40=Shaft/axis of rotation for light shield
42=Means for selectably moving condenser lens/ring frame
44=Means for selectably moving light shield
46=Means for selectably moving reflector
48=Means for selectably moving light source
A=Angle between reflector/condenser axes and horizontal
B=Angle between condenser axis and horizontal
C=Angle between reflector axis and horizontal
D=Displacement between condenser axis and horizontal
E=Displacement between reflector axis and horizontal
F=Displacement between light source and horizontal
F1=First focal point
F2=Second focal point
H=Horizontal axis As illustrated in FIGS. 1A–B, a first embodiment of the present invention includes: (a) a generally elliptical reflector 10 having a reflector axis 12 (also sometime referred to as an "optical axis"), first and second focal points F1/F2 located along the reflector axis, and a forward-facing reflector opening 14; (b) a light source 16 from which light waves may emanate, the light source being located substantially at the first foal point F1; (c) a light shield 20 disposed generally beneath the second focal point F2 and having a top edge 22; (d) a condenser lens 24 having a condenser axis 26, the condenser lens being disposed forward of the reflector opening 14 and spaced apart from the second focal point F2 effective to substantially collimate the light waves generally in the forward direction; and (e) means for selectably moving the light shield, the reflector, and the condenser lens between the low beam and high beam conditions. In the low beam condition (illustrated in FIG. 1A), the reflector and condenser axes 12/26 are substantially collinear and substantially parallel to the horizontal axis H, and the light shield 20 is oriented in a first position (e.g., generally upright) wherein the top edge 22 is positioned immediately beneath the second focal point F2. In the high beam condition (see FIG. 1B), the reflector and condenser axes 12/26 remain substantially collinear but are raised by an angle A with respect to the horizontal axis H, and the light shield 20 is oriented in a second position (e.g., tilted/rotated, or downwardly translated) wherein the top edge 22 is lowered away from the second focal point F2. A typical range for the angle A is $0° < A \leqq 5°$, with $1° < A \leqq 3°$ being a preferred range. Although not shown in the drawings, the headlamp may also include a housing which encloses one or more components of the headlamp assembly, with the housing having an open end thereof through which the collimated light rays may pass from the condenser lens 24.

Figure 7A:
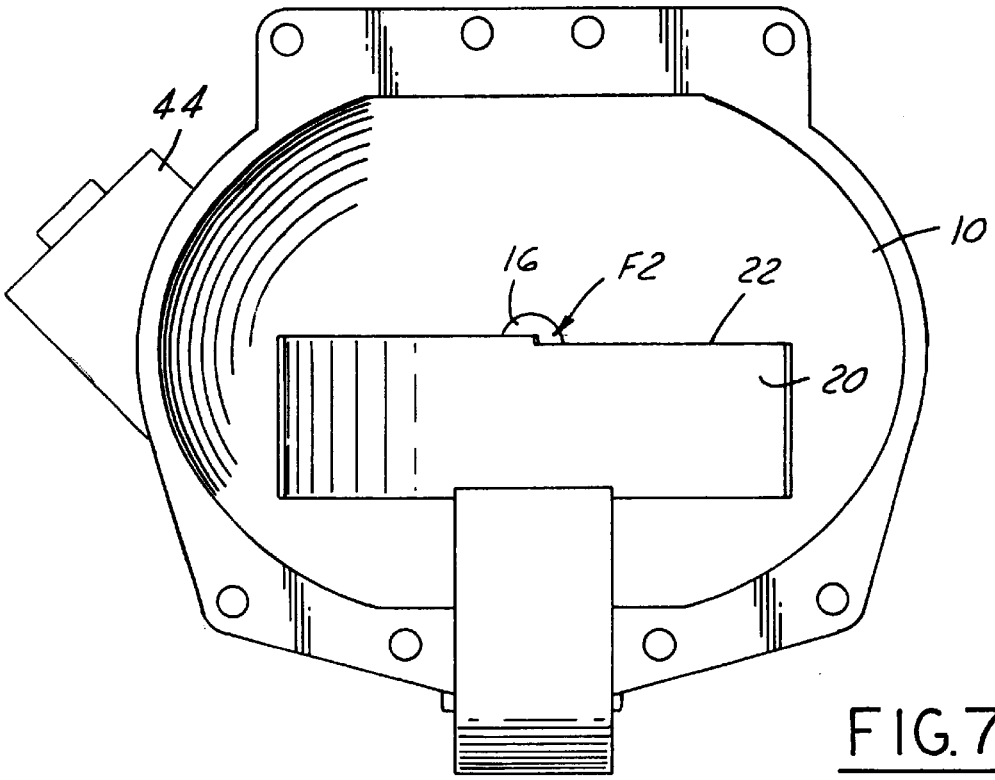
FIGS. 7A–F are various perspective views of selected embodiments of the present invention.
Figure 7B:
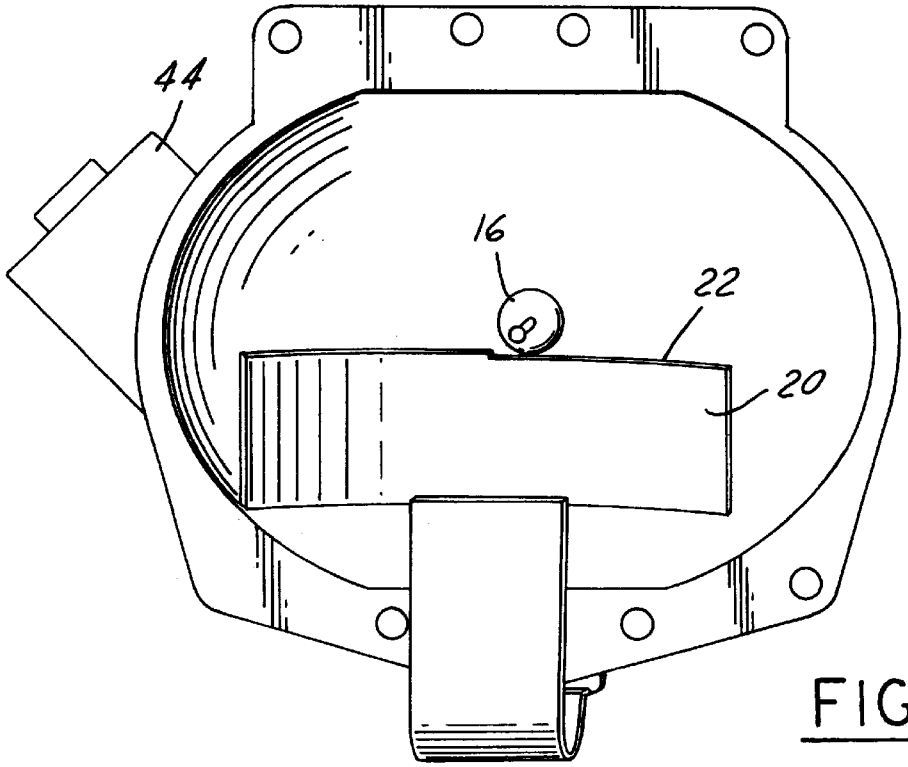
Figure 7C:
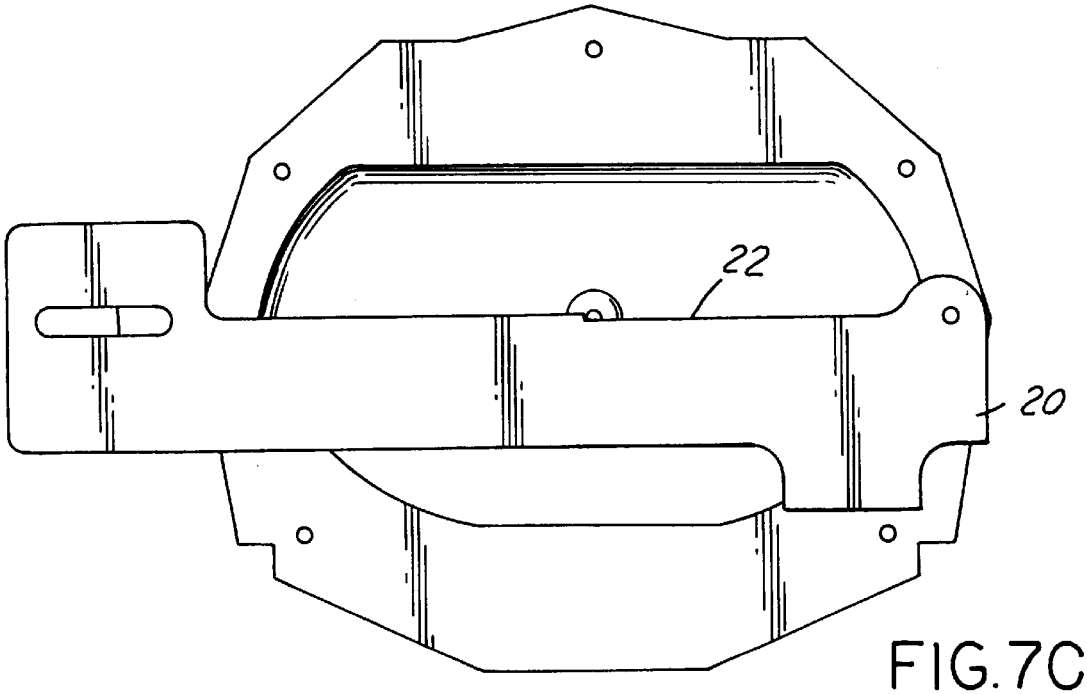
Figure 7D:
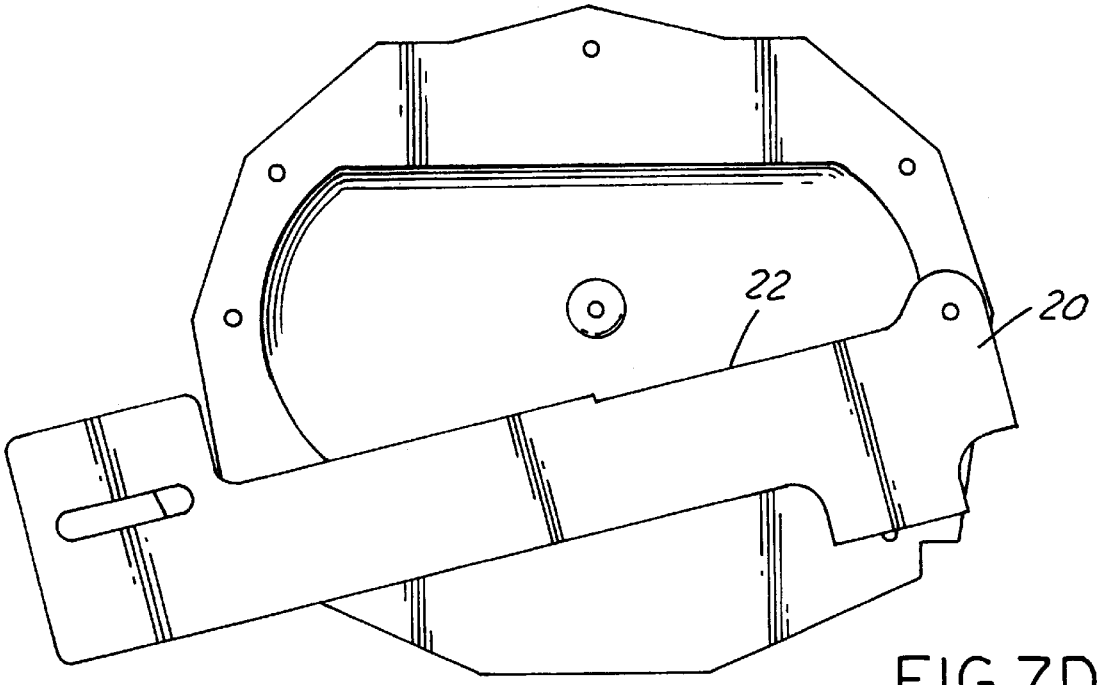
Figure 7E:
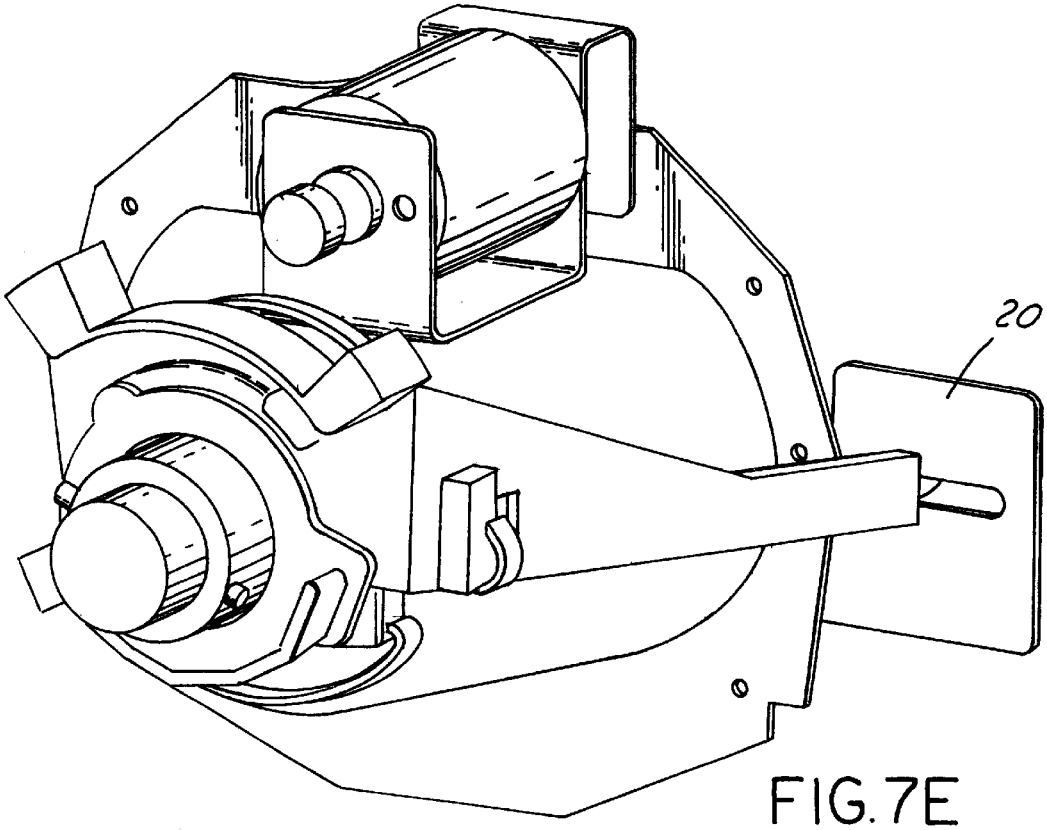
Figure 7F:
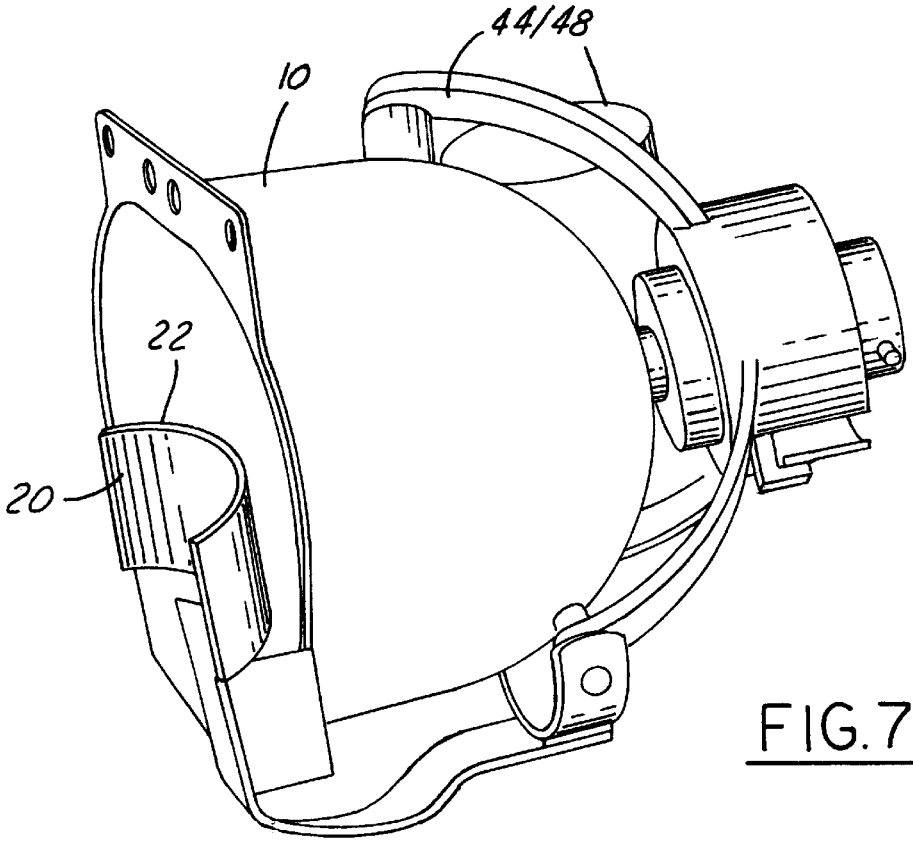

The headlamp further includes means 46 for moving the reflector 10, means 42 for moving the condenser lens 24, and means 44 for moving the light shield 20. If the light source 16 is attached to the reflector 10, then the light source may rotate along with the reflector; however, if the light source is separately movable with respect to the reflector, then a separate means 48, as seen in FIG. 7F, for moving the light source may be needed. Each of the various means 42/44/46/48 moves a respective element 24/20/10/16 between the orientations needed for the low beam and high beam lighting conditions. Each of the means 42/44/46/48 may include one or more solenoids, motors, cams, followers, linkages, gears, bearings, pumps, and/or the like, and may be actuated electrically, electronically, mechanically, electromechanically, inductively, magnetically, optically, hydraulically, pneumatically, and/or the like.

As variously required by each embodiment of the present invention, each means for moving may effect rotational motion and/or translational motion of the element which it moves. For example, as illustrated in FIGS. 4C–D (relating to a fourth embodiment, described more fully below), the means 42/44 for moving the condenser lens 24 and the light shield 20 may include a gearbox (combined here into a single unit) connected to a rotatable shaft 40 (attached to or integral with the light shield 20) and a translatable set of linkages 36 (attached to a fixed condenser lens ring frame 34). FIG. 4C illustrates a low beam condition, in which the light shield 20 is placed in a generally upright orientation with its top edge 22 just under the second focal point F2, and with the condenser lens 24 being positioned with its axis 26 substantially parallel with the horizontal H. When it is desired to shift from low beam to high beam, the means 42/44 rotates the light shield 20 so that its top edge 22 is moved away from the second focal point F2, while extending the linkages 36 so as to push forward on the lower portion of the condenser lens ring 30 which holds the lens 24. As arranged in FIG. 4D, when the linkages 36 are urged forward, the condenser lens and ring 24/30 pivot about pins 32 that are captured in pivot holes formed in the ring frame 34, thereby tilting the lens 24 upward such that its axis 26 forms a desired angle B with respect to the horizontal H.

Figure 2A:
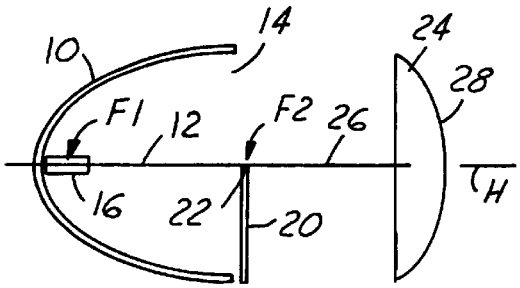
FIGS. 2A–B are side schematic views of a projector headlamp according to a second embodiment of the present invention, showing low beam and high beam conditions, respectively.
Figure 2B:
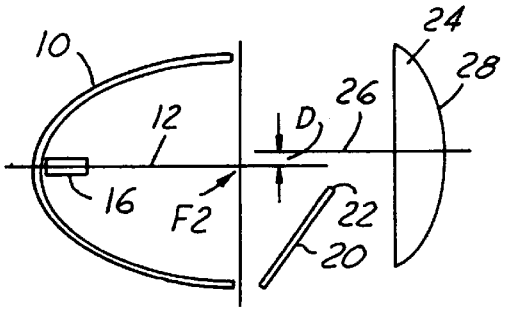

A second embodiment is illustrated in FIGS. 2A–B. Here, the projector headlamp has essentially the same structure as in the first embodiment, except that the means for moving in the present embodiment include only a means for selectably moving the light shield 20 and the condenser lens 24. For the low beam condition, the arrangements of the headlamp elements for the first and second embodiments are essentially the same (see FIGS. 1A and 2A, respectively); however, for the high beam condition, the respective arrangements differ from one another. Specifically, for the high beam condition of the second embodiment, the reflector and condenser lens axes 12/26 are presented substantially parallel to the horizontal H, with the condenser axis 26 being raised by a predetermined distance D above the unmoved reflector axis 12. Although the predetermined distance D will vary from one projector design to another, the distance should generally fall within the range of 0 mm <D≦5 mm.

Figure 3A:
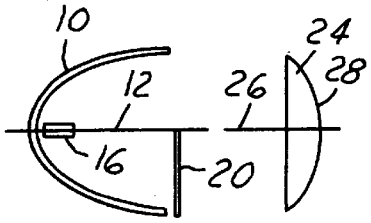
FIGS. 3A–D are side schematic views of a projector headlamp according to a third embodiment of the present invention, showing low beam and high beam conditions, respectively.
Figure 3C:
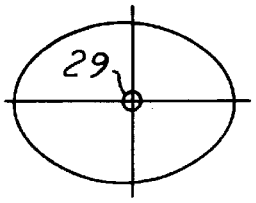
Figure 3B:
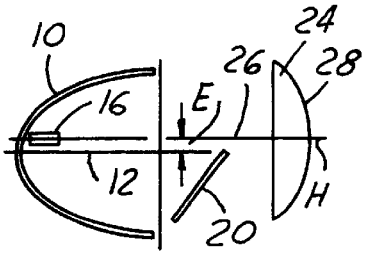
Figure 3D:
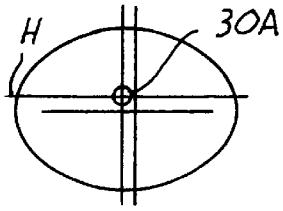

A third embodiment is illustrated in FIGS. 3A–B. Here, the projector headlamp has essentially the same structure as in the first embodiment, except that the means for moving in the present embodiment include only a means for selectably moving the light shield 20 and the reflector 10. For the low beam condition, the arrangements of the headlamp elements for the first and third embodiments are essentially the same (see FIGS. 1A and 3A, respectively); however, for the high beam condition, the respective arrangements differ from one another. Specifically, for the high beam condition of the third embodiment, the reflector and condenser lens axes 12/26 are presented substantially parallel to the horizontal H, with the reflector and reflector axis 10/12 being lowered by a predetermined distance E below the unmoved condenser lens/condenser axis 24/26. Although the predetermined distance E will vary from one projector design to another, the distance should generally fall within the range of 0 mm<E≦5 mm. <E ≦5 mm.

Figure 4A:
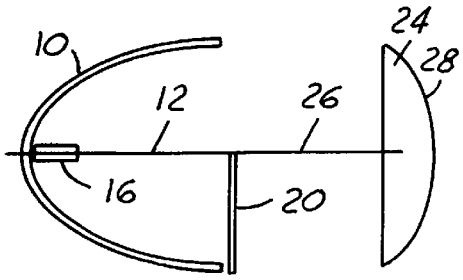
FIGS. 4A–B are side schematic views of a projector headlamp according to a fourth embodiment of the present invention, showing low beam and high beam conditions, respectively.
Figure 4B:
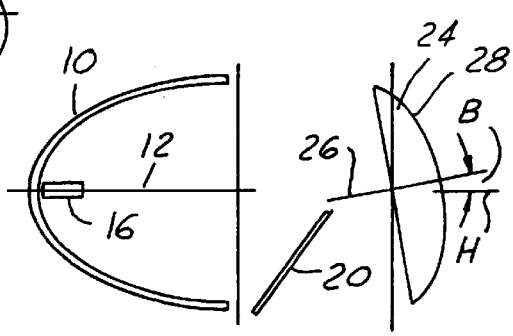
Figure 4C:
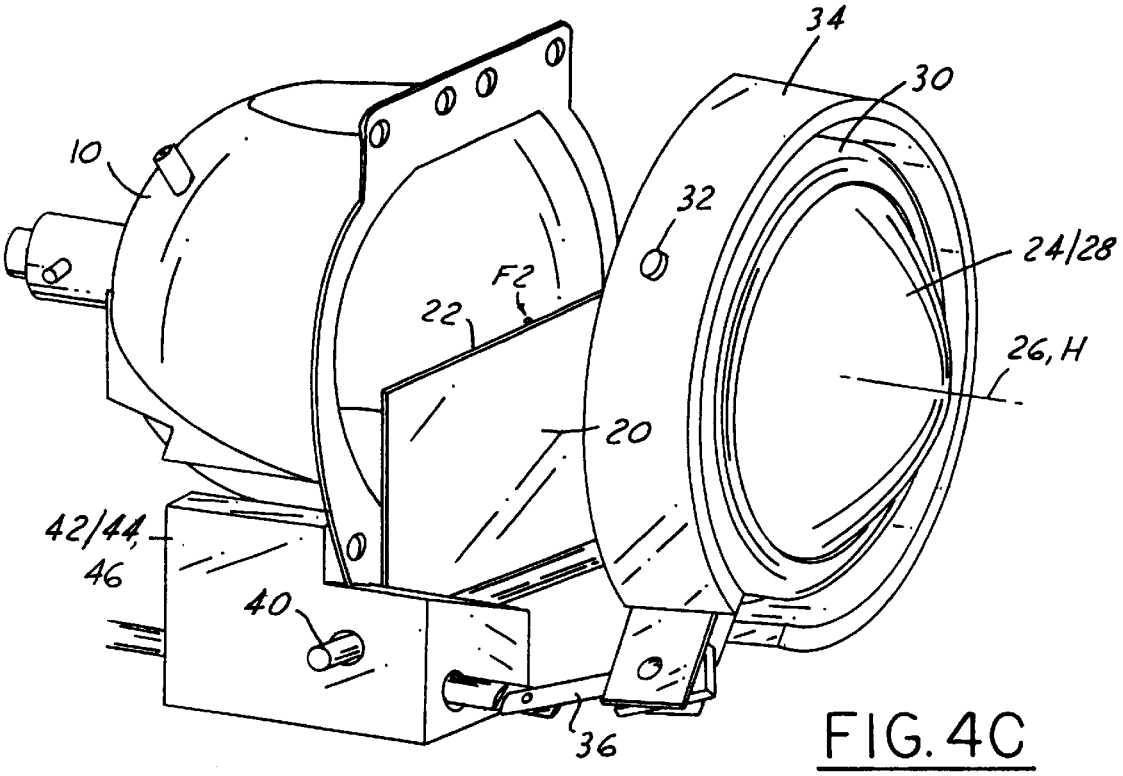
FIGS. 4C–D are perspective views of the projector headlamp represented in FIGS. 4A–B, respectively.
Figure 4D:
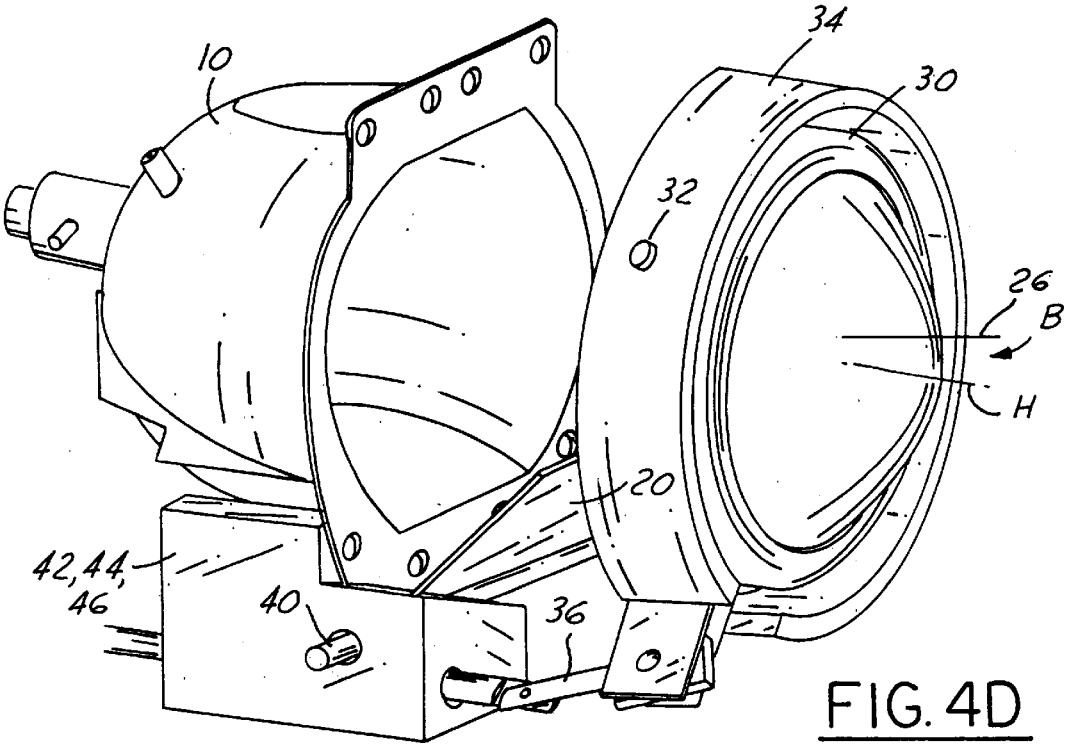

A fourth embodiment is illustrated in FIGS. 4A–B. Here, the projector headlamp has essentially the same structure as in the first embodiment, except that the means for moving in the present embodiment include only a means for selectably moving the light shield 20 and the condenser lens 24. For the low beam condition, the arrangements of the headlamp elements for the first and fourth embodiments are essentially the same (see FIGS. 1A and 4A, respectively); however, for the high beam condition, the respective arrangements differ from one another. Specifically, for the high beam condition of the fourth embodiment, the reflector axis 12 is presented substantially parallel to the horizontal H, with the forward face 28 of the condenser lens 24 being tilted upward such that the condenser axis 26 is raised by an angle B with respect to the horizontal H. The range for this angle B should generally fall within the range of 0°<B≦5°, with a range of about 1°≦B ≦3° being preferred.

Figure 5A:
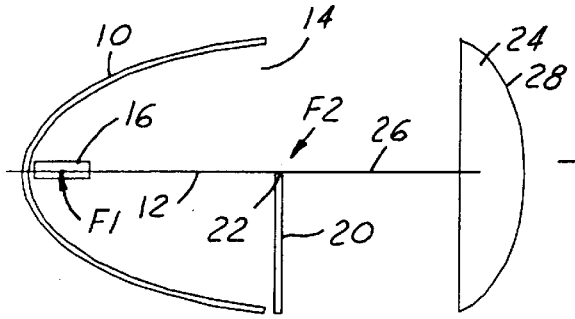
FIGS. 5A–B are side schematic views of a projector headlamp according to a fifth embodiment of the present invention, showing low beam and high beam conditions, respectively.
Figure 5B:
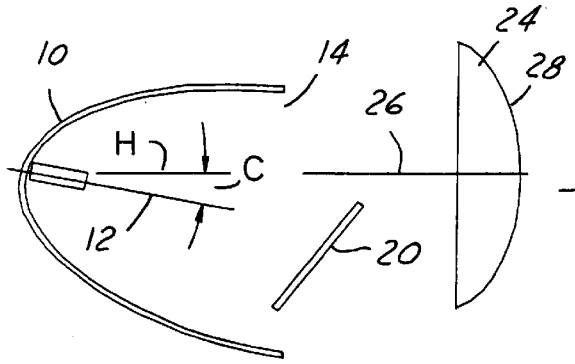

A fifth embodiment is illustrated in FIGS. 5A–B. Once again, the projector headlamp of this embodiment has essentially the same structure as in the first embodiment, except that the means for moving includes only a means for selectably moving the light shield 20 and the reflector 10. For the low beam condition, the arrangements of the headlamp elements for the first and fifth embodiments are essentially the same (see FIGS. 1A and 5A, respectively); however, for the high beam condition, the respective arrangements differ from one another. Specifically, for the high beam condition of the present embodiment, the condenser lens axes 26 is presented substantially parallel to the horizontal H, with the reflector opening 14 being tilted downward such that the reflector axis 12 is lowered by an angle C with respect to the horizontal H. A typical range for the angle C may be 0°<C≦5°, with a preferred range of 1°≦C≦3°.

Figure 6A:
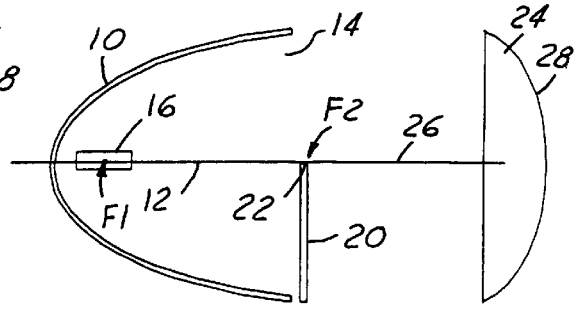
FIGS. 6A–B are side schematic views of a projector headlamp according to a sixth embodiment of the present invention, showing low beam and high beam conditions, respectively.
Figure 6B:
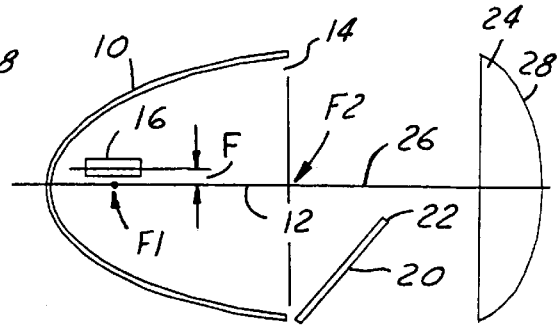
Figure 8:
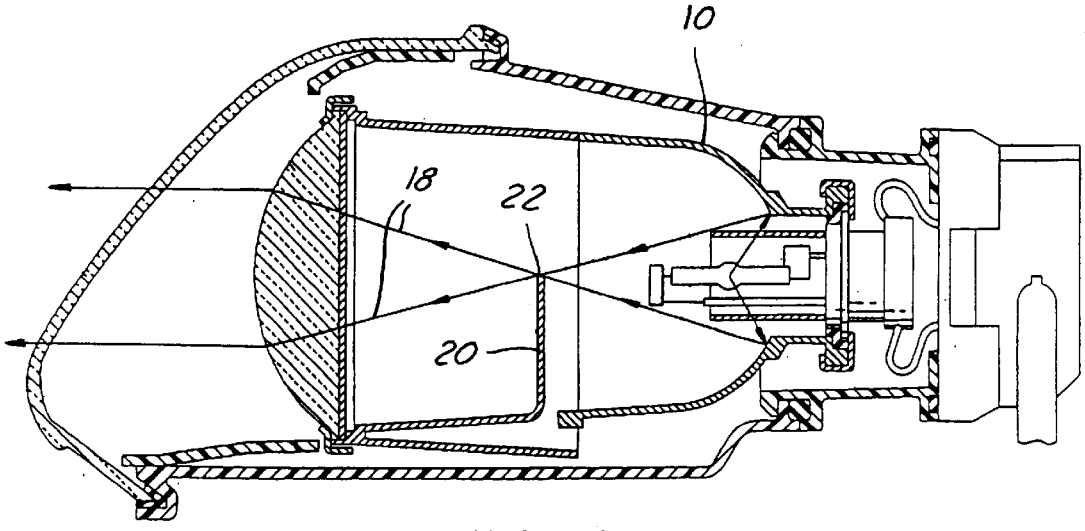
(PRIOR ART) FIG.8
FIG. 8 is a side section view of a projector headlamp according to the prior art.

A sixth embodiment is illustrated in FIGS. 6A–B. In this embodiment, the projector headlamp has generally the same structure as in the first embodiment, except that the means for moving include only a means for selectably moving the light shield 20 and the light source 16. For the low beam condition, the light source 16 is positioned substantially coincident with the first focal point F1, and the light shield 20 is oriented in a first position in which the top edge 22 is positioned immediately beneath the second focal point F2. (For comparison, see FIGS. 1A and 6A). For the high beam condition, the light shield 20 is oriented in a second position such that the top edge 22 is lowered away from the second focal point F2, and the light source 16 is raised above the first focal point F1 by a predetermined distance F, with a typical range of 0 mm <F≦5 mm. In both the low beam and high beam conditions, the condenser lens 24 and reflector 10 are arranged such that their axes 26/12 are presented substantially coaxial with one another and parallel with the horizontal H.

In each of the foregoing embodiments, one or more elements within the headlamp assembly—i.e., the reflector 10, the condenser lens 24, the light source 16, and/or the light shield 20—are selectably moved between their respective low beam and high beam positions by a certain angle (i.e., A, B, or C) or a certain displacement (i.e., D, E, or F) so as to shift the respective low beam and high beam hot spots to the required points in space (as required by the FMVSS and/or other regulations or requirements).

Various other modifications to the present invention may occur to those skilled in the art to which the present invention pertains. For example, although the present invention is especially suited for use with HID lamps, it is also possible that other types of light sources might equally well be used. Also, for some designs it may be desirable to mount the light source 16 within the reflector 10 (with the light source 16 coinciding with the first focal point F1, of course); however, for other designs it may instead be desirable to have the light source not mounted directly to the reflector, such as is the case in the sixth embodiment of the present invention. Other modifications not explicitly mentioned herein are also possible and within the scope of the present invention. It is the following claims, including all equivalents, which define the scope of the present invention.

What is claimed is:

1. A projector headlamp for projecting light in a forward direction generally along a horizontal axis selectably between high beam and low beam conditions, said projector headlamp comprising:

(a) a generally elliptical reflector having a reflector axis, first and second focal points located along said reflector axis, and a forward-facing reflector opening;

(b) a light source from which light waves may emanate, said light source being located substantially at said first focal point;

(c) a light shield disposed generally beneath said second focal point and having a top edge;

(d) a condenser lens having a condenser axis, said condenser lens being disposed forward of said reflector opening and spaced apart from said second focal point effective to substantially collimate said light waves generally in said forward direction; and (e) means for selectably moving said light shield, said reflector, and said condenser lens between said low beam and high beam conditions;

(f) wherein in said low beam condition:

(i) said reflector axis and said condenser axis are substantially collinear and substantially parallel to said horizontal axis, and (ii) said light shield is oriented in a first position wherein said top edge is positioned immediately beneath said second focal point; and (g) wherein in said high beam condition:

(i) said reflector axis and said condenser axis are substantially collinear and raised by an angle A with respect to said horizontal axis, and (ii) said light shield is oriented in a second position wherein said top edge is lowered away from said second focal point.

2. A projector headlamp according to claim 1, wherein $0° < A \leqq 5°$.

3. A projector headlamp according to claim 1, wherein $1° \leqq A \leqq 3°$.

4. A projector headlamp for projecting light in a forward direction generally along a horizontal axis selectably between high beam and low beam conditions, said projector headlamp comprising:

(a) a generally elliptical reflector having a reflector axis, first and second focal points located along said reflector axis, and a forward-facing reflector opening;

(b) a light source from which light waves may emanate, said light source being located substantially at said first focal point;

(c) a light shield disposed generally beneath said second focal point and having a top edge;

(d) a condenser lens having a condenser axis, said condenser lens being disposed forward of said reflector opening and spaced apart from said second focal point effective to substantially collimate said light waves generally in said forward direction; and (e) means for selectably moving said light shield and said condenser lens between said low beam and high beam conditions;

(f) wherein in said low beam condition:

(i) said reflector axis and said condenser axis are substantially collinear and substantially parallel to said horizontal axis, and (ii) said light shield is oriented in a first position wherein said top edge is positioned immediately beneath said second focal point; and (g) wherein in said high beam condition:

(i) said reflector axis and said condenser axis are substantially parallel to said horizontal axis and said condenser axis is raised by a predetermined distance D above said reflector axis, and (ii) said light shield is oriented in a second position wherein said top edge is lowered away from said second focal point.

5. A projector headlamp according to claim 4, wherein $0 \text{ mm} < D \leqq 5 \text{ mm}$.

6. A projector headlamp for projecting light in a forward direction generally along a horizontal axis selectably between high beam and low beam conditions, said projector headlamp comprising:

(a) a generally elliptical reflector having a reflector axis, first and second focal points located along said reflector axis, and a forward-facing reflector opening;

(b) a light source from which light waves may emanate, said light source being located substantially at said first focal point;

(c) a light shield disposed generally beneath said second focal point and having a top edge;

(d) a condenser lens having a condenser axis, said condenser lens being disposed forward of said reflector opening and spaced apart from said second focal point effective to substantially collimate said light waves generally in said forward direction; and (e) means for selectably moving said light shield and said reflector between said low beam and high beam conditions;

(f) wherein in said low beam condition:

(i) said reflector axis and said condenser axis are substantially collinear and substantially parallel to said horizontal axis, and (ii) said light shield is oriented in a first position wherein said top edge is positioned immediately beneath said second focal point; and (g) wherein in said high beam condition:

(i) said reflector axis and said condenser axis are substantially parallel to said horizontal axis and said reflector axis is lowered by a predetermined distance E below said condenser axis, and (ii) said light shield is oriented in a second position wherein said top edge is lowered away from said second focal point.

7. A projector headlamp according to claim 6, wherein $0 \text{ mm} < E \leqq 5 \text{ mm}$.

8. A projector headlamp for projecting light in a forward direction generally along a horizontal axis selectably between high beam and low beam conditions, said projector headlamp comprising:

(a) a generally elliptical reflector having a reflector axis, first and second focal points located along said reflector axis, and a forward-facing reflector opening;

(b) a light source from which light waves may emanate, said light source being located substantially at said first focal point;

(c) a light shield disposed generally beneath said second focal point and having a top edge;

(d) a condenser lens having a forward face and a condenser axis, said condenser lens being disposed forward of said reflector opening and spaced apart from said second focal point effective to substantially collimate said light waves generally in said forward direction; and (e) means for selectably moving said light shield and said condenser lens between said low beam and high beam conditions;

(f) wherein in said low beam condition:

(i) said reflector axis and said condenser axis are substantially collinear and substantially parallel to said horizontal axis, and (ii) said light shield is oriented in a first position wherein said top edge is positioned immediately beneath said second focal point; and (g) wherein in said high beam condition:

(i) said reflector axis is substantially parallel with said horizontal axis, and said forward face of said condenser lens is tilted upward such that said condenser axis is raised by an angle B with respect to said horizontal axis, and (ii) said light shield is oriented in a second position wherein said top edge is lowered away from said second focal point.

9. A projector headlamp according to claim 8, wherein $0° < B \leqq 5°$.

10. A projector headlamp according to claim 8, wherein $1° \leqq B \leqq 3°$.

11. A projector headlamp for projecting light in a forward direction generally along a horizontal axis selectably between high beam and low beam conditions, said projector headlamp comprising:

(a) a generally elliptical reflector having a reflector axis, first and second focal points located along said reflector axis, and a forward-facing reflector opening;

(b) a light source from which light waves may emanate, said light source being located substantially at said first focal point;

(c) a light shield disposed generally beneath said second focal point and having a top edge;

(d) a condenser lens having a condenser axis, said condenser lens being disposed forward of said reflector opening and spaced apart from said second focal point effective to substantially collimate said light waves generally in said forward direction; and (e) means for selectably moving said light shield and said reflector between said low beam and high beam conditions;

(f) wherein in said low beam condition:

(i) said reflector axis and said condenser axis are substantially collinear and substantially parallel to said horizontal axis, and (ii) said light shield is oriented in a first position wherein said top edge is positioned immediately beneath said second focal point; and (g) wherein in said high beam condition:

(i) said condenser axis is substantially parallel with said horizontal axis, and said reflector opening is tilted downward such that said reflector axis is lowered by an angle C with respect to said horizontal axis, and (ii) said light shield is oriented in a second position wherein said top edge is lowered away from said second focal point.

12. A projector headlamp according to claim 11, wherein $0° < C \leqq 5°$.

13. A projector headlamp according to claim 11, wherein $1° < C \leqq 3°$.

14. A projector headlamp for projecting light in a forward direction generally along a horizontal axis selectably between high beam and low beam conditions, said projector headlamp comprising:

(a) a generally elliptical reflector having a reflector axis, first and second focal points located along said reflector axis, and a forward-facing reflector opening;

(b) a light source from which light waves may emanate, said light source being located generally proximate said first focal point;

(c) a light shield disposed generally beneath said second focal point and having a top edge;

(d) a condenser lens having a condenser axis substantially coaxial with said reflector axis, said condenser lens being disposed forward of said reflector opening and spaced apart from said second focal point effective to substantially collimate said light waves generally in said forward direction; and (e) means for selectably moving said light shield and said light source between said low beam and high beam conditions;

(f) wherein in said low beam condition:

(i) said light source is positioned substantially coincident with said first focal point, and (ii) said light shield is oriented in a first position wherein said top edge is positioned immediately beneath said second focal point; and (g) wherein in said high beam condition:

(i) said light source is positioned above said first focal point by a predetermined distance F, and (ii) said light shield is oriented in a second position wherein said top edge is lowered away from said second focal point.

15. A projector headlamp according to claim 14, wherein $0\text{mm} < F \leqq 5\text{ mm}$.

* * * * *